US008802337B2

(12) United States Patent
Kawasaki et al.

(10) Patent No.: US 8,802,337 B2
(45) Date of Patent: Aug. 12, 2014

(54) ELECTROPHOTOGRAPHIC PHOTORECEPTOR, IMAGE FORMING APPARATUS, AND PROCESS CARTRIDGE

(71) Applicant: Fuji Xerox Co., Ltd., Tokyo (JP)

(72) Inventors: Akihiro Kawasaki, Kanagawa (JP); Shigeto Hashiba, Kanagawa (JP); Hirofumi Nakamura, Kanagawa (JP); Hidemi Nukada, Kanagawa (JP); Satoya Sugiura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/672,353

(22) Filed: Nov. 8, 2012

(65) Prior Publication Data

US 2013/0316275 A1 Nov. 28, 2013

(30) Foreign Application Priority Data

May 22, 2012 (JP) ..... 2012-116808

(51) Int. Cl.
*G03G 5/14* (2006.01)

(52) U.S. Cl.
CPC ..... *G03G 5/144* (2013.01)
USPC ..... 430/60; 430/63; 430/65; 399/111; 399/159

(58) Field of Classification Search
USPC ..... 430/60, 63, 65; 399/111, 159
See application file for complete search history.

(56) References Cited

U.S. PATENT DOCUMENTS

| | | | | |
|---|---|---|---|---|
| 5,658,702 | A | 8/1997 | Nukada | |
| 5,795,690 | A | 8/1998 | Takegawa et al. | |
| 5,815,776 | A | 9/1998 | Nukada | |
| 7,186,490 | B1 * | 3/2007 | Niimi et al. | 430/78 |
| 2006/0014090 | A1 * | 1/2006 | Shiino et al. | 430/59.1 |
| 2006/0014091 | A1 * | 1/2006 | Nukada et al. | 430/60 |
| 2006/0014092 | A1 * | 1/2006 | Nukada et al. | 430/60 |
| 2009/0010664 | A1 * | 1/2009 | Nukada et al. | 399/49 |
| 2011/0183255 | A1 * | 7/2011 | Kurimoto et al. | 430/133 |
| 2013/0065169 | A1 * | 3/2013 | Iwasaki | 430/56 |
| 2013/0236821 | A1 * | 9/2013 | Ide et al. | 430/56 |
| 2013/0252147 | A1 * | 9/2013 | Sugiura et al. | 430/56 |

FOREIGN PATENT DOCUMENTS

| | | | | |
|---|---|---|---|---|
| DE | 19829055 | A1 * | 1/1999 | G03G 5/047 |
| JP | A-07-175249 | | 7/1995 | |
| JP | A-08-044097 | | 2/1996 | |
| JP | A-08-166679 | | 6/1996 | |
| JP | A-09-197701 | | 7/1997 | |
| JP | A-11-133649 | | 5/1999 | |
| JP | A-2010-091796 | | 4/2010 | |

OTHER PUBLICATIONS

English language machine translation of DE 198 29 055 (Jan. 1999).*

* cited by examiner

*Primary Examiner* — Christopher Rodee
(74) *Attorney, Agent, or Firm* — Oliff PLC

(57) ABSTRACT

An electrophotographic photoreceptor includes a support; an undercoat layer which is provided on the support and contains at least a binder resin, metal oxide particles, and an electron-accepting compound having an anthraquinone structure, in which a content of the electron-accepting compound is from 0.5% by weight to 1.5% by weight with respect to the metal oxide particles and a contact angle of the metal oxide particles with respect to water is from 7° to 12°; and a photosensitive layer which is provided on the undercoat layer.

15 Claims, 8 Drawing Sheets

ELECTROPHOTOGRAPHIC PHOTORECEPTOR, IMAGE FORMING APPARATUS, AND PROCESS CARTRIDGE

CROSS-REFERENCE TO RELATED APPLICATIONS

This application is based on and claims priority under 35 USC 119 from Japanese Patent Application No. 2012-116808 filed May 22, 2012.

BACKGROUND

1. Technical Field

The present invention relates to an electrophotographic photoreceptor, an image forming apparatus, and a process cartridge.

2. Related Art

Electrophotographic image forming apparatuses perform printing with high speed and quality and are used for image forming apparatuses such as copying machines and laser beam printers. As photoreceptors used in image forming apparatuses, organic photoreceptors formed of organic photoconductive materials are used in general. When an organic photoreceptor is manufactured, there are many cases where an undercoat layer is formed on a support formed of, for example, aluminum, and then a photosensitive layer, in particular, a photosensitive layer including a charge generation layer and a charge transport layer is formed.

SUMMARY

According to an aspect of the invention, there is provided an electrophotographic photoreceptor including: a support; an undercoat layer which is provided on the support and contains at least a binder resin, metal oxide particles, and an electron-accepting compound having an anthraquinone structure, in which a content of the electron-accepting compound is from 0.5% by weight to 1.5% by weight with respect to the metal oxide particles and a contact angle of the metal oxide particles with respect to water is from 7° to 12°; and a photosensitive layer which is provided on the undercoat layer.

BRIEF DESCRIPTION OF THE DRAWINGS

Exemplary embodiments of the present invention will be described in detail based on the following figures, wherein.

DETAILED DESCRIPTION

Figure 1:
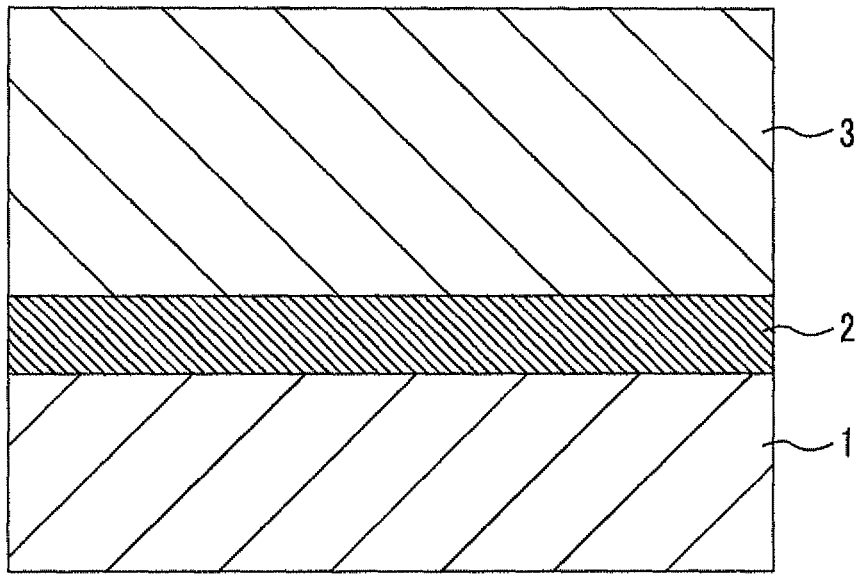
FIG. 1 is a diagram schematically illustrating an example of a layer configuration of an electrophotographic photoreceptor according to an exemplary embodiment of the invention.

Hereinafter, exemplary embodiments of the invention will be described in detail.

Electrophotographic Photoreceptor

An electrophotographic photoreceptor (hereinafter, simply referred to as "a photoreceptor") according to an exemplary embodiment of the invention includes a support, an undercoat layer which is provided on the support, and a photosensitive layer which is provided on the undercoat layer. That is, the photoreceptor according to the exemplary embodiment includes the undercoat layer and the photosensitive layer on the support in this order.

The undercoat layer at least contains a binder resin, metal oxide particles, and an electron-accepting compound having an anthraquinone structure. The content of the electron-accepting compound is from 0.5% by weight to 1.5% by weight with respect to the metal oxide particles, and the contact angle of the metal oxide particles with respect to water is from 7° to 12°.

For the purpose of suppressing ghosting and changes in cycle characteristics, for example, as a technique of improving a blocking property (property of suppressing charges from being injected from an undercoat layer to a photosensitive layer), there are known techniques, for example, a technique of improving a hole blocking property using a silane coupling agent containing an amino group; and a method of adding an additive, such as an electron-accepting material or an electron transport material, to an undercoat layer to improve an electron injecting property.

However, with these techniques, characteristics required for an electrophotographic photoreceptor to suppress ghosting and changes in cycle characteristics are currently lacking and further improvement is desired.

Therefore, in the photoreceptor according to the exemplary embodiment, with the above-described configuration, ghosting (a phenomenon in which the history of a previous image remains and an afterimage is generated) and changes in cycle characteristics (electrical characteristics caused by repetitive use) are suppressed.

The reason is not clear but is considered to be as follows.

First, it is considered that, by adding the electron-accepting compound having a large amount of anthraquinone structure in the above-described range to the metal oxide particles, changes in cycle characteristics is suppressed but ghosting easily occurs. The reason is considered to be as follows. By adding the electron-accepting compound, an electron transport property is improved, the corrosion of the support (for example, an aluminum support) is suppressed, and therefore changes in cycle characteristics are suppressed. However, by the Fermi level of the undercoat layer being changed, charges easily accumulate between the undercoat layer and the photosensitive layer (for example, a charge generation layer) in the short term. As a result, ghosting occurs.

Meanwhile, it is considered that, by adding the hydrophobic metal oxide particles having a contact angle with respect to water in the above-described range (the water contact angle of metal oxide particles in the related art is about 5°), ghosting is suppressed and changes in cycle characteristics are further suppressed. The reason is considered to be as follows. By adding the hydrophobic metal oxide particles, 1) the number of charge accumulation sites (hereinafter, referred to as "trap sites") which are present inside the metal oxide particles, 2) the number of structural trap sites which are formed on the interface between the metal oxide particles, and 3) the number of structural trap sites which are present on the interface between the metal oxide particles and the resin are reduced. As a result, ghosting, in which charges, trapped during exposure of the previous cycle, appear as the history in the next cycle, and changes in cycle characteristics, in which charges accumulate in deep traps and an internal electric field gradually increases in a long-term cycle, are suppressed. In addition, it is considered that the number of the trap sites is reduced because the metal oxide particles are hydrophobic and thus the adsorptivity of charges to a surface of the resin or the electron-accepting compound is changed.

In this way, it is considered that, in the photoreceptor according to the exemplary embodiment, ghosting and changes in cycle characteristics are suppressed.

Hereinafter, the photoreceptor according to the exemplary embodiment will be described with reference to the drawings.

FIGS. 1 to 6 are diagrams schematically illustrating examples of a layer configuration of the photoreceptor according to the exemplary embodiment.

Figure 2:
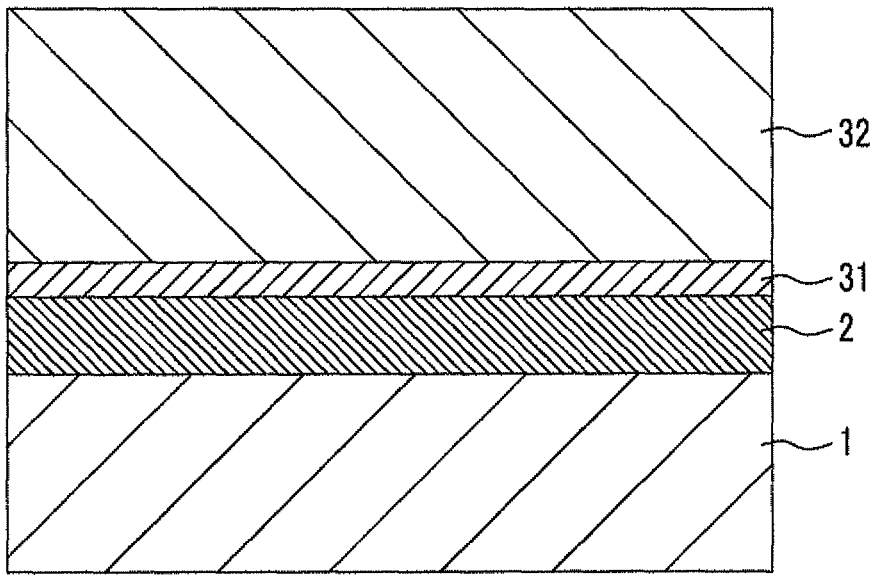
FIG. 2 is a diagram schematically illustrating another example of a layer configuration of an electrophotographic photoreceptor according to an exemplary embodiment of the invention.
Figure 3:
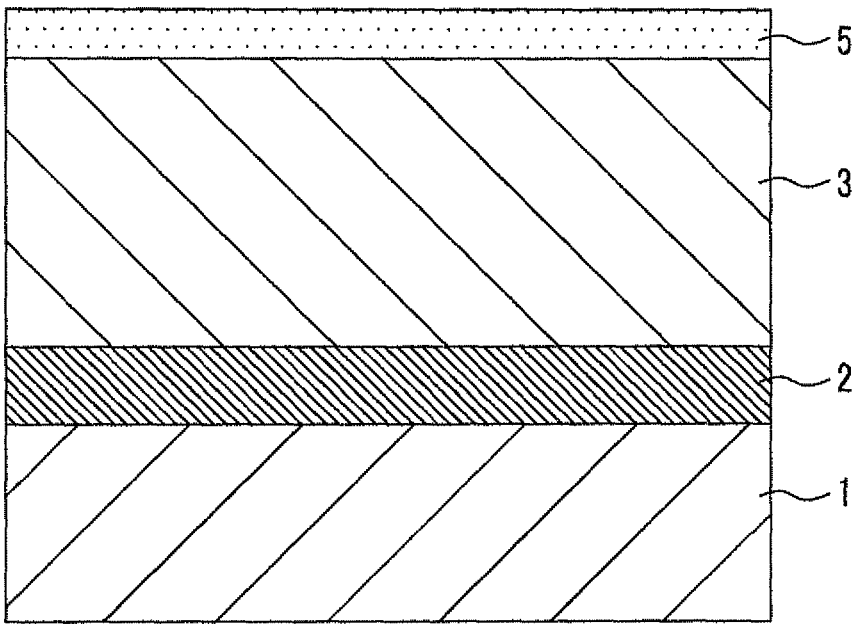
FIG. 3 is a diagram schematically illustrating another example of a layer configuration of an electrophotographic photoreceptor according to an exemplary embodiment of the invention.
Figure 4:
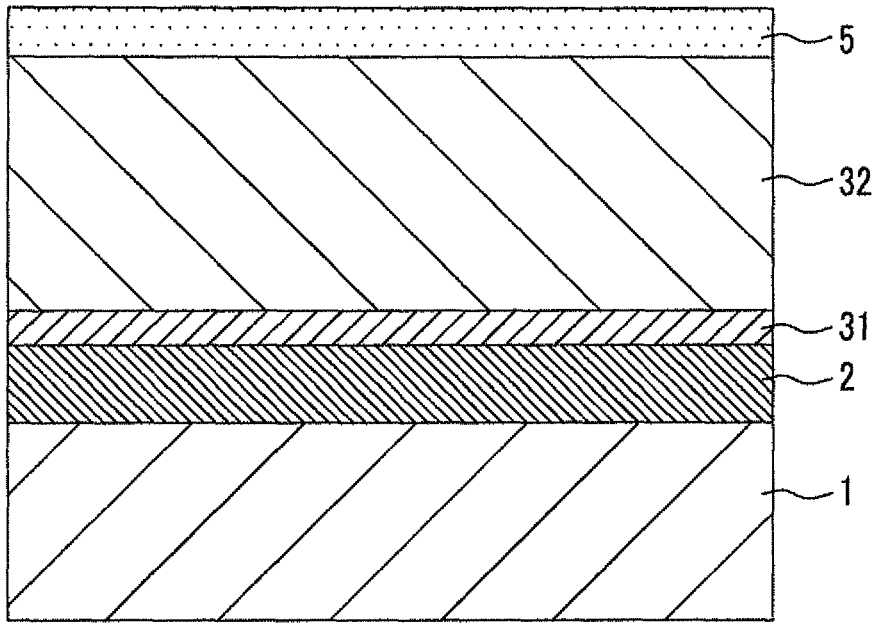
FIG. 4 is a diagram schematically illustrating another example of a layer configuration of an electrophotographic photoreceptor according to an exemplary embodiment of the invention.
Figure 5:
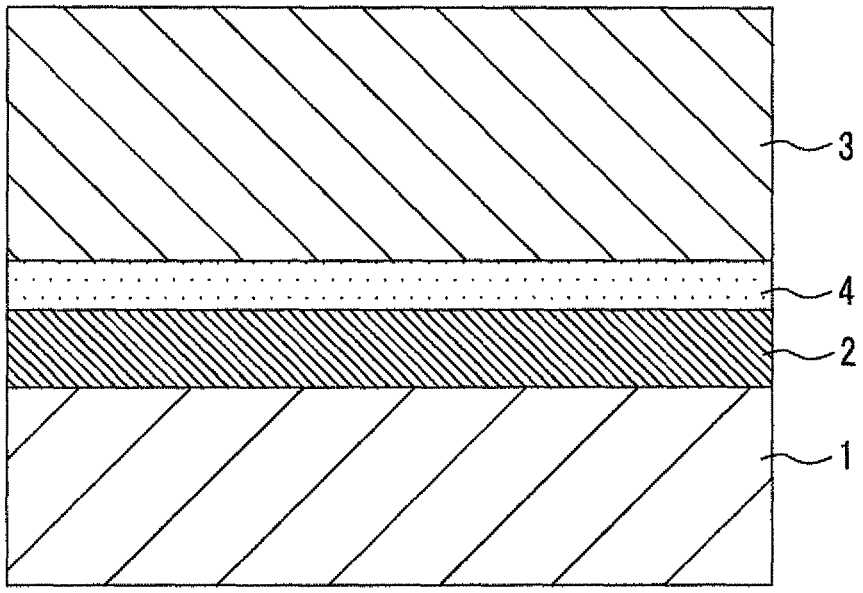
FIG. 5 is a diagram schematically illustrating another example of a layer configuration of an electrophotographic photoreceptor according to an exemplary embodiment of the invention.
Figure 6:
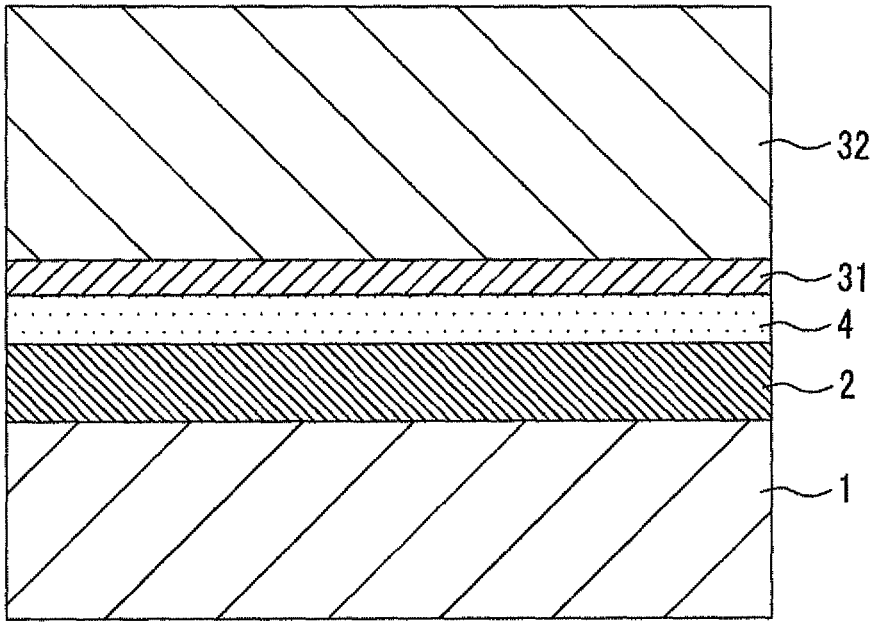
FIG. 6 is a diagram schematically illustrating another example of a layer configuration of an electrophotographic photoreceptor according to an exemplary embodiment of the invention.

A photoreceptor illustrated in FIG. 1 includes a support 1, an undercoat layer 2 which is formed on the support 1, and a photosensitive layer 3 which is formed on the undercoat layer 2. In addition, as illustrated in FIG. 2, the photosensitive layer 3 may have a two-layer structure including a charge generation layer 31 and a charge transport layer 32. Furthermore, as illustrated in FIGS. 3 and 4, a protective layer 5 may be provided on the photosensitive layer 3 or the charge transport layer 32. In addition, as illustrated in FIGS. 5 and 6, an interlayer 4 may be provided between the undercoat layer 2 and the photosensitive layer 3 or between the undercoat layer 2 and the charge generation layer 31.

Support

Examples of the support 1 include conductive supports. Specific examples of the support 1 include metal plates, metal drums, and metal belts including a metal such as aluminum, copper, zinc, stainless steel, chromium, nickel, molybdenum, vanadium, indium, gold, or platinum or an alloy thereof; and papers, plastic films, and belts in which a conductive compound, such as a conductive polymer or indium oxide, and a metal, such as aluminum, palladium, or gold, or an alloy thereof are coated, deposited, or laminated. "The conductivity" described herein represents the volume resistivity being less than $10^{13}$ Ωcm.

When the photoreceptor is used for a laser printer, it is preferable that a surface of the support 1 be roughened such that a center line average roughness Ra be from 0.04 μm to 0.5 μm. However, when a light source emits incoherent light, roughening is not necessarily performed.

Preferable examples of roughening include wet honing of suspending an abrasive in water and spraying the suspension onto the support; centerless grinding of bringing the support into contact with a rotating grindstone and continuously grinding the support; and anodic oxidation.

In addition, another preferable example of roughening includes a method of, not roughening the surface of the support 1, but dispersing conductive or semi-conductive particles in the resin to form a layer on the surface of the support and performing roughening with the particles dispersed in the layer.

Roughening using the anodic oxidation is to use aluminum as an anode and perform anodic oxidation in an electrolyte solution to form an oxide film on a surface of aluminum. Examples of the electrolyte solution include sulfuric acid solutions and oxalate solutions. However, a porous anodic oxide film which is formed using anodic oxidation, is chemically active as it is. Therefore, it is preferable that a sealing treatment of sealing pores of the anodic oxide film through volume expansion using a hydration reaction in steam under pressure or in boiling water (to which a salt of a metal such as nickel may be added) be performed to obtain a more stable hydrated oxide. The thickness of the anodic oxide film is preferably from 0.3 μm to 15 μm.

The support 1 may be subjected to a treatment using an acid aqueous solution or a boehmite treatment.

The treatment using an acid aqueous solution including phosphoric acid, chromic acid, and hydrofluoric acid is performed as follows. First, the acid aqueous solution is prepared. Regarding the mixing ratio of phosphoric acid, chromic acid, and hydrofluoric acid in the acid aqueous solution, it is preferable that the content of the phosphoric acid be from 10% by weight to 11% by weight, the content of the chromic acid be from 3% by weight to 5% by weight, the content of the hydrofluoric acid be from 0.5% by weight to 2% by weight, and the concentration of all the acids be from 13.5% by weight to 18% by weight. The treatment temperature is preferably from 42° to 48°. The thickness of a coating film is preferably from 0.3 μm to 15 μm.

The boehmite treatment is performed by dipping the support in pure water at from 90° C. to 100° C. for 5 minutes to 60 minutes or by bringing the support into contact with heated steam at from 90° C. to 120° C. for 5 minutes to 60 minutes. The thickness of a coating film is preferably from 0.1 μm to 5 μm. The resultant may be further subjected to anodic oxidation using an electrolyte solution having a lower solubility in the coating film than that of the other kinds, such as adipic acid, boric acid, borate, phosphate, phthalate, maleate, benzoate, tartrate, and citrate.

Undercoat Layer

The undercoat layer 2 at least contains a binder resin, metal oxide particles, and an electron-accepting compound having an anthraquinone structure, and optionally further includes other additives.

Binder Resin

As the binder resin included in the undercoat layer 2, well-known resins may be used, and examples thereof include well-known polymer resin compounds such as acetal resins such as polyvinylbutyral, polyvinyl alcohol resins, caseins, polyamide resins, cellulosic resins, gelatins, polyurethane resins, polyester resins, polyether resins, methacrylic resins, acrylic resins, polyvinylchloride resins, polyvinyl acetate resins, vinyl chloride-vinyl acetate-maleic anhydride resins, silicone resins, silicone-alkyd resins, urea resins, phenol resins, phenol-formaldehyde resins, melamine resins, unsaturated urethane resins, alkyd resins, and epoxy resins; and electron transport resins having an electron transport group and conductive resins such as polyaniline. Among these, a resin which is insoluble in a coating solvent of an upper layer is preferably used, and preferable examples thereof include thermosetting resins such as urea resins, phenol resins, phenol-formaldehyde resins, melamine resins, urethane resins, unsaturated polyester resins, alkyd resins, and epoxy resins; and resins obtained by a reaction of a curing agent and at least one kind of resin selected from a group consisting of polyamide resins, polyester resins, polyether resins, acrylic resins, polyvinyl alcohol resins, and polyvinyl acetal resins.

When a combination of two or more kinds among these is used, the mixing ratio thereof is set as appropriate.

Metal Oxide Particles

The contact angle of the metal oxide particles with respect to water is from 7° to 12° and is preferably from 9° to 11°.

When the contact angle of the metal oxide particles is less than 7°, cycle characteristics change.

On the other hand, when the contact angle of the metal oxide particles is greater than 12°, ghosting and changes in cycle characteristics occur.

The contact angle of the metal oxide particles is set to the above-described range by, for example, adjusting the kind and the treatment amount of a surface treating agent described below.

A method of measuring the contact angle of the metal oxide particles is as follows.

First, ultrasonic waves are applied to a methyl ethyl ketone solution of 1% w/v of metal oxide particles for 30 minutes for uniform dispersion and 1.5 mL of the resultant is cast onto a glass plate (2.4 cm×2.4 cm), followed by drying at 100° C. for 10 minutes. As a result, a uniform film is prepared. About 2 μL of distilled water is slowly added dropwise onto the film, a contact angle is obtained from an angle of a line connecting left and right end points and the apex of a liquid droplet with respect to a solid surface (θ/2 method), and the average of contact angles at 10 positions is obtained as the contact angle of the metal oxide particles.

The volume average particle size of the metal oxide particles is preferably from 50 nm to 200 nm and more preferably from 70 nm to 120 nm.

The volume average particle size of the metal oxide particles is measured using a laser diffraction particle size distribution analyzer (LA-700, manufactured by Horiba Ltd.). In a measurement method, 2 g (in terms of solid content) of a sample in the dispersion state is prepared, ion exchange water is added thereto such that the total amount is 40 ml, the resultant is poured into a cell so as to have an appropriate concentration, and the measurement is performed after 2 minutes. Volume average particle sizes of the respective channels accumulate in order from the lowest value and a cumulative value of 50% is obtained as the volume average particle size of the metal oxide particles.

The powder resistivity (volume resistivity) of the metal oxide particles is preferably from $10^2$ Ω·cm to $10^{11}$ Ω·cm.

The BET specific surface area of the metal oxide particles is preferably greater than or equal to 10 $m^2/g$.

Examples of the metal oxide particles include particles of metal oxide such as tin oxide, titanium oxide, zinc oxide, and zirconium oxide. Among these, zinc oxide is particularly preferable.

The surfaces of the metal oxide particles may be treated. In addition, two or more kinds of particles subjected to different surface treatments, particles having different particle sizes, and the like may be combined and used.

The surface treating agent is selected from well-known materials, and examples thereof include a silane coupling agent, a titanate coupling agent, an aluminum coupling agent, and a surfactant. Among these, a silane coupling agent, in particular, a silane coupling agent having an amino group is preferable.

As the silane coupling agent having an amino group, any materials may be used, and specific examples thereof include γ-aminopropyltriethoxysilane, N-β-(aminoethyl)-γ-aminopropyltrimethoxysilane, N-β-(aminoethyl)-γ-aminopropylmethylmethoxysilane, and N,N-bis(β-hydroxylethyl)-γ-aminopropyltriethoxysilane. However, the silane coupling agent having an amino group is not limited thereto.

A mixture of two or more kinds of silane coupling agents may be used. However, examples of a silane coupling agent, which may be used in combination with the silane coupling agent having an amino group, include vinyltrimethoxysilane, γ-methacryloxypropyl-tris(β-methoxyethoxy) silane, β-(3,4-epoxycyclohexyl)ethyltrimethoxysilane, γ-glycidoxypropyltrimethoxysilane, vinyltriacetoxysilane, γ-mercaptopropyltrimethoxysilane γ-aminopropyl triethoxysilane, N-β-(aminoethyl)-γ-aminopropyl trimethoxysilane, N-β-(aminoethyl)-γ-aminopropylmethyldimethoxysilane, N,N-bis(β-hydroxylethyl)-7-aminopropyl triethoxysilane, and γ-chloropropyltrimethoxysilane. However, the silane coupling agent which may be used in combination is not limited thereto.

As the surface treatment method, well-known methods may be used, and a dry method and a wet method are preferably used.

The amount of the surface treating agent with respect to the metal oxide particles is set such that the contact angle of the metal oxide particles with respect to water is in the above-described range, and specifically, is preferably, for example, from 0.5% by weight to 1.25% by weight with respect to the metal oxide particles.

The content of the metal oxide particles (in terms of solid content) is preferably from 10% by weight to 80% by weight and more preferably from 30% by weight to 60% by weight.

Electron-Accepting Compound

The electron-accepting compound (acceptor compound) is an electron-accepting compound having an anthraquinone structure. "The compound having an anthraquinone structure" described herein represents at least one kind selected from anthraquinone and anthraquinone derivatives.

Specific examples of the electron-accepting compound include hydroxyanthraquinone compounds, aminoanthraquinone compounds, and aminohydroxyanthraquinone compounds.

Among these, as the electron-accepting compound, electron-accepting compounds having a hydroxyl group (for example, hydroxyanthraquinone compounds and aminohydroxyanthraquinone compounds) are preferable, and specifically, electron-accepting compounds represented by Formula (I) below are preferable.

Formula (1)

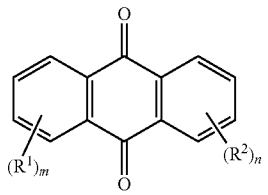

In Formula (I), $R^1$ and $R^2$ each independently represent a hydroxyl group, a methyl group, a methoxymethyl group, a phenyl group, an amino group, or an alkoxy group; and m and n each independently represent an integer of from 0 to 4.

In addition, in Formula (I), a compound in which both of m and n represent 0 is anthraquinone, and compounds in which at least one of m and n represents an integer of from 1 to 4 are anthraquinone derivatives. That is, the anthraquinone derivatives are compounds in which at least one hydrogen atom included in anthraquinone is substituted with a substituent such as a hydroxyl group, a methyl group, a methoxymethyl group, a phenyl group, an amino group, or an alkoxy group.

When m and n each represent 2 or more, $R^1$ and $R^2$ may be the same or different, respectively.

Among the above-described examples, preferable examples of the electron-accepting compound include anthraquinone in which both of m and n represent 0 in Formula (I) and hydroxyanthraquinone in which $R^1$ represents a hydroxyl group, m represents an integer of from 1 to 3, and n represents 0 in Formula (1).

Specific examples of the electron-accepting compound include anthraquinone, purpurin, alizarin, quinizarin, ethylanthraquinone, and aminohydroxyanthraquinone.

The electron-accepting compound may be just added during the application of the undercoat layer 2 or may be attached onto the surfaces of the metal oxide particles in advance. Examples of a method of attaching the electron-accepting compound onto the surfaces of the metal oxide particles include a dry method and a wet method.

When the surface treatment is performed in which the electron-accepting compound is attached onto the surfaces of the metal oxide particles with a dry method, the electron-accepting compound is added dropwise to the metal oxide particles directly or after dissolving the electron-accepting compound in an organic solvent while stirring the metal oxide particles using a mixer or the like having a large shearing force, followed by spraying along with dry air or nitrogen gas. It is preferable that adding or spraying be performed at a temperature lower than a boiling point of the solvent. After adding and spraying, baking may be further performed at 100° C. or higher. The temperature and time of baking may be set in an appropriate range.

When the surface treatment is performed in which the electron-accepting compound is attached onto the surfaces of the metal oxide particles with a wet method, the metal oxide particles are stirred in a solvent and dispersed using ultrasonic waves, a sand mill, an attritor, a ball mill, or the like; the electron-accepting compound is added thereto; the resultant is stirred and dispersed; and the solvent is removed. The solvent is removed by filtration or distillation. After the solvent is removed, baking may be further performed at 100° C. or higher. The temperature and time of baking may be set in an appropriate range. In the wet method, before adding a surface treating agent, water included in the metal oxide particles may be removed, and examples thereof include a method of heating the solvent, used for the surface treatment, under stirring to remove water and a method of azeotroping water with the solvent to be removed.

The content of the electron-accepting compound is from 0.5% by weight to 1.5% by weight, more preferably from 0.75% by weight to 1.25% by weight, and still more preferably from 0.75% by weight to 1.0% by weight, with respect to the metal oxide particles.

When the content of the electron-accepting compound is less than 0.5% by weight, ghosting and changes in cycle characteristics occur.

When the content of the electron-accepting compound is greater than 1.5% by weight, ghosting occurs.

Other Additives

Examples of other additives include electron transport pigments such as condensed polycyclic pigments or azo pigments; and well-known materials such as zirconium chelate compounds, titanium chelate compounds, aluminum chelate compounds, titanium alkoxide compounds, organic titanium compounds, and silane coupling agents.

Characteristics of Undercoat Layer

The thickness of the undercoat layer 2 is preferably from 20 μm to 50 μm, more preferably from 20 μm to 40 μm, and still more preferably from 23 μm to 33 μm.

When the thickness of the undercoat layer 2 is greater than or equal to 20 μm, ghosting is more easily suppressed. In addition, image defects such as pinhole leakage are easily suppressed.

When the thickness of the undercoat layer 2 is less than or equal to 50 μm, changes in cycle characteristics are easily suppressed.

The undercoat layer 2 has a resistance value of preferably from $1\times10^8\Omega$; to $1\times10^{10}\Omega$ and more preferably from $1\times10^9\Omega$ to $1\times10^{10}\Omega$, in AC impedance measurement.

A specific method of measuring a resistance value of the undercoat layer 2 is as follows.

First, an impedance of the undercoat layer 2 is measured. In a sample for impedance measurement, using a support such as an aluminum pipe as a cathode and a gold electrode as an anode, an alternating current of 1 Vp-p is applied in order from the highest frequency in a frequency range of 1 MHz to 1 mHz and an AC impedance of each sample is measured. By fitting a graph of a Cole-Cole plot, obtained by the measurement, to an RC parallel equivalent circuit, a resistance value of the undercoat layer 2 is obtained.

A method of preparing samples of the undercoat layer for resistance measurement from the electrophotographic photoreceptor, is as follows. For example, coating films, such as a charge generation layer and a charge transport layer, which cover the undercoat layer are removed using a solvent such as acetone, tetrahydrofuran, methanol, or ethanol; and a gold electrode is mounted onto the exposed undercoat layer with a vacuum deposition method or a sputtering method. As a result, samples of the undercoat layer for measuring a volume resistivity are prepared.

Examples of a method of adjusting a resistance value of the undercoat layer 2 to the above-described range, include a method of adjusting the amount added or the particle sizes of the metal oxide particles and a method of changing a method of dispersing the metal oxide particles in an undercoat-layer-forming coating solution. As the particle sizes of the metal oxide particles increases, the resistance value of the undercoat layer 2 has a tendency to decrease. In addition, as the amount of the metal oxide particles added increases, the resistance value of the undercoat layer 2 has a tendency to increase. Furthermore, when the dispersibility of the metal oxide particles in the undercoat-layer-forming coating solution is improved, the resistance value of the undercoat layer 2 has a tendency to increase. Specifically, as the dispersion time in the undercoat-layer-forming coating solution increases, the resistance value of the undercoat layer 2 has a tendency to increase.

The resistance value of the undercoat layer 2 is also adjusted by the drying temperature when the undercoat layer is formed. As the drying temperature increases, the resistance value of the undercoat layer 2 has a tendency to decrease.

It is preferable that the undercoat layer 2 have a Vickers hardness of 35 or higher.

In addition, in order to prevent a moire fringe, the surface roughness (the average of surface roughnesses at ten points) of the undercoat layer 2 is adjusted to be ¼n (n represents the refractive index of an upper layer) of the wavelength λ of exposure laser light to be used to ½λ.

In order to adjust the surface roughness, particles of a resin or the like may be added to the undercoat layer 2. Examples of the resin particles include silicone resin particles and cross-linked polymethylmethacrylate resin particles. In addition, in order to adjust the surface roughness, the undercoat layer 2 may be polished. Examples of a polishing method include buffing, sand blasting, wet honing, and grinding.

Formation of Undercoat Layer

When the undercoat layer 2 is formed, the undercoat-layer-forming coating solution, in which the above-described components are added to a solvent, is used. The solvent for preparing the undercoat-layer-forming coating solution is selected from known organic solvents such as alcohols, aromatic solvents, halogenated hydrocarbons, ketones, ketone alcohols, ethers, and esters. Examples of the solvent include well-known organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

In addition, as the solvent used for dispersion, the above examples may be used alone or as a mixture of two or more kinds. As solvents used for preparing a solvent mixture, any solvents may be used as long as the binder resin is soluble in the mixture thereof.

Examples of a dispersion method include well-known methods using a roll mill, a ball mill, a vibration ball mill, an attritor, a sand mill, a colloid mill, a paint shaker or the like.

For example, in the case of dispersion using a sand mill with glass beads having a diameter of 1 mm, it is preferable that the dispersion conditions be set as follows: a filling ratio of from 70% to 95% and a dispersion time of 0.1 hour to 100 hours.

The metal oxide particles and the electron-accepting compound, which are reactive with the metal oxide particles, may be caused to react with each other during the above-described dispersion process or during a drying and curing process of the coating film. It is preferable that the reaction be performed in a dispersion.

Examples of a coating method used for providing the undercoat layer 2 include well-known methods such as a blade coating method, a wire-bar coating method, a spray coating method, a dip coating method, a bead coating method, an air knife coating method, and a curtain coating method.

The undercoat layer 2 is formed by coating the undercoat-layer-forming solution on the support 1 and drying the resultant.

Drying is usually performed under a condition of a temperature that can evaporate a solvent to form a film, for example, preferably from 150° C. to 200° C., more preferably from 160° C. to 200° C., and still more preferably from 170° C. to 190° C. In addition, the drying time is preferably from 10 minutes to 50 minutes and more preferably from 20 minutes to 40 minutes.

Interlayer

Examples of a constituent material of the interlayer 4 include polymer resin compounds such as acetal resins such as polyvinylbutyral, polyvinyl alcohol resins, caseins, polyamide resins, cellulosic resins, gelatins, polyurethane resins, polyester resins, methacrylic resins, acrylic resins, polyvinylchloride resins, polyvinyl acetate resins, vinyl chloride-vinyl acetate-maleic anhydride resins, silicone resins, silicone-alkyd resins, phenol-formaldehyde resins, and melamine resins; and organometallic compounds containing zirconium, titanium, aluminum, manganese, silicon atom, or the like.

These compounds may be used alone or as a mixture or a polycondensate of plural compounds. Among these, organometallic compounds containing zirconium or silicon are preferable.

The thickness of the interlayer 4 is preferably from 0.1 μm to 3 μm.

Charge Generation Layer

The charge generation layer 31 may include a charge generation material alone, or may include a charge generation material and a binder resin and optionally other additives.

Charge Generation Material

As the charge generation material, well-known charge generation materials may be used, but from the viewpoint of obtaining superior performance, phthalocyanine pigments are particularly preferably used. In addition, these organic pigments usually include several kinds of crystal forms. Any crystal forms may be used as long as a pigment obtains a target sensitivity. In particular, specific examples of the charge generation material which are preferably used are as follows.

Examples of the charge generation material include phthalocyanine pigments such as metal-free phthalocyanine, chlorogallium phthalocyanine, hydroxygallium phthalocyanine, dichlorotin phthalocyanine, and titanyl phthalocyanine. In particular, for example, a chlorogallium phthalocyanine crystal having distinct diffraction peaks at Bragg angles (2θ±0.2°) with respect to CuKα characteristic X-rays of at least 7.4°, 16.6°, 25.5°, and 28.3°; a metal-free phthalocyanine crystal having distinct diffraction peaks at Bragg angles (2θ±θ0.2° with respect to CuKα characteristic X-rays of at least 7.7°, 9.3°, 16.9°, 17.5°, 22.4°, and 28.8°; a hydroxygallium phthalocyanine crystal having distinct diffraction peaks at Bragg angles (2θ±0.2°) with respect to CuKα characteristic X-rays of at least 7.5°, 9.9°, 12.5°, 16.3°, 18.6°, 25.1°, and 28.3°; a titanyl phthalocyanine crystal having distinct diffraction peaks at Bragg angles (2θ±0.2°) with respect to CuKα characteristic X-rays of at least 9.6°, 24.1°, and 27.2°; and a titanyl phthalocyanine crystal having distinct diffraction peaks at Bragg angles (2θ±0.2°) with respect to CuKα characteristic X-rays of at least 7.6°, 18.3°, 23.2°, 24.2°, and 27.3° are used. In addition, examples of the charge generation material include quinine pigments, perylene pigments, indigo pigments, bisbenzimidazole pigments, anthrone pigments, and quinacridone pigments. In addition, as the charge generation material, these examples may be used alone or as a mixture of two or more kinds.

Among these, the hydroxygallium phthalocyanine crystal having distinct diffraction peaks at Bragg angles (2θ±0.2°) with respect to CuKα characteristic X-rays of at least 7.5°, 9.9°, 12.5°, 16.3°, 18.6°, 25.1°, and 28.3°; and the titanyl phthalocyanine crystal having distinct diffraction peaks at Bragg angles (2θ±0.2°) with respect to CuKα characteristic X-rays of at least 7.6°, 18.3°, 23.2°, 24.2°, and 27.3° are preferable.

The charge generation material is prepared by, for example, mechanically dry-pulverizing a pigment crystal, obtained using a well-known method, with an automatic mortar, a planetary mill, a vibration mill, a CF mill, a roller mill, a sand mill, a kneader, or the like; or by dry-pulverizing a pigment crystal and wet-pulverizing the resultant with a solvent using a ball mill, a mortar, a sand mill, a kneader, or the like. Examples of the solvent used for the above-described treatment include aromatic solvents (for example, toluene and chlorobenzene), amides (for example, dimethylformamide and N-methylpyrrolidone), aliphatic alcohols (for example, methanol, ethanol, and butanol), aliphatic polyols (for example, ethylene glycol, glycerin, and polyethylene glycol), aromatic alcohols (for example, benzyl alcohol and phenethyl alcohol), esters (for example, acetate and butyl acetate), ketones (for example, acetone and methyl ethyl ketone), dimethylsulfoxide, and ethers (for example, diethyl ether and tetrahydrofuran). Furthermore, mixed solvents of plural kinds or mixtures of water and these organic solvents may also be used.

The amount of the solvent used is preferably from 1 part to 200 parts and more preferably from 10 parts to 100 parts (in terms of weight ratio) with respect to the pigment crystal.

The treatment temperature is preferably from 0° C. to a boiling point of the solvent and more preferably from 10° C. to 60° C.

In addition, during pulverizing, a grinding aid such as common salt or salt cake is used. The amount of the grinding aid used is preferably from 0.5 times to 20 times and more preferably from 1 time to 10 times the pigment.

In addition, the pigment crystal obtained using a well-known method is controlled by acid pasting or by a combination of acid pasting and the above-described dry or wet pulverizing method. As an acid used for acid pasting, sulfuric acid is preferable, and a concentration thereof is preferably from 70% to 100% and more preferably from 95% to 100%. The dissolution temperature is preferably −20° C. to 100° C. and more preferably from 0° C. to 60° C. The amount of concentrated sulfuric acid is preferably from 1 time to 100 times and more preferably from 3 times to 50 times the weight of the pigment crystal. As a solvent for precipitation, water or a mixed solvent of water and an organic solvent is used in an appropriate amount. The temperature for precipitation is not particularly limited, but in order to prevent heat generation, it is preferable that cooling be performed using ice or the like.

Binder Resin

The binder resin is selected from a wide range of insulating resins and may be selected from organic photoconductive polymers such as poly-N-vinyl carbazole, polyvinyl anthracene, polyvinyl pyrene, and polysilane.

Preferable examples of the binder resin include insulating resins such as polyvinyl acetal resins, polyarylate resins (for example, polycondensates of bisphenol A and phthalic acid), polycarbonate resins, polyester resins, phenoxy resins, vinyl chloride-vinyl acetate copolymers, polyamide resins, acrylic resins, polyacrylamide resins, polyvinylpyridine resins, cellulosic resins, urethane resins, epoxy resins, caseins, polyvinyl alcohol resins, and polyvinylpyrrolidone resins. However, the binder resin isnot limited thereto. As the binder resin, the above examples may be used alone or as a mixture of two or more kinds. Among these, polyvinyl acetal resins are preferably used.

It is preferable that the mixing ratio (in terms of weight ratio) of the binder resin to the charge generation material be from 10:1 to 1:10.

Other Additives

Examples of other additives include electron transport materials such as quinone compounds (for example, chloranil, bromanil, and anthraquinone), tetracyanoquinodimethane compounds, fluorenone compounds (for example, 2,4,7-trinitrofluorenone, and 2,4,5,7-tetranitro-9-fluorenone), oxadiazole compounds (for example, 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole), xanthone compounds, thiophene compounds, diphenoquinone compounds (for example, 3,3',5,5'-tetra-t-butyl-diphenoquinone); electron transport pigments such as condensed polycyclic pigments and azo pigments; and well-known materials such as zirconium chelate compounds, titanium chelate compounds, aluminum chelate compounds, titanium alkoxide compounds, organic titanium compounds, and silane coupling agents.

Examples of the silane coupling agents, the zirconium chelate compounds, the titanium chelate compounds, and the aluminum chelate compounds are the same as above.

Characteristics of Charge Generation Layer

The thickness of the charge generation layer 31 is preferably from 0.01 μm to 5 μm and more preferably from 0.05 μm to 2.0 μm.

Formation of Charge Generation Layer

When the charge generation layer 31 is formed, a charge-generation-layer-forming coating solution, in which the above-described components are added to a solvent, is used. The charge generation layer 31 may be formed by making a film of the charge generation material with vacuum deposition.

The solvent for preparing the charge-generation-layer-forming coating solution may be selected from known organic solvents such as alcohols, aromatic solvents, halogenated hydrocarbons, ketones, ketone alcohols, ethers, and esters. Examples of the solvent include well-known organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

As the solvent used for dispersion, the above examples may be used alone or as a mixture of two or more kinds. As solvents used for preparing a solvent mixture, any solvents may be used as long as the binder resin is soluble in the mixture thereof.

Examples of a dispersion method include well-known methods using a roll mill, a ball mill, a vibration ball mill, an attritor, a sand mill, a colloid mill, a paint shaker or the like.

For the dispersion, it is effective that the particle sizes are preferably less than or equal to 0.5 μm, more preferably less than or equal to 0.3 μm, and still more preferably less than or equal to 0.15 μm.

Examples of a coating method used for providing the charge generation layer 31 include well-known methods such as a blade coating method, a wire-bar coating method, a spray coating method, a dip coating method, a bead coating method, an air knife coating method, and a curtain coating method.

Charge Transport Layer

For example, the charge transport layer 32 includes a charge transport material and optionally, may further include a binder resin and other additives.

Charge Transport Material

As the charge transport material, well-known materials are used and examples thereof are as follows. Examples thereof include hole transport materials such as oxadiazole derivatives (for example, 2,5-bis(p-diethylaminophenyl)-1,3,4-oxadiazole), pyrazoline derivatives (for example, 1,3,5-triphenyl-pyrazoline and 1-[pyridyl-(2)]-3-(p-diethylaminostyryl)-5-(p-diethylamino styryl)pyrazoline), aromatic tertiary amino compounds (for example, triphenylamine, tri(P-methyl)phenylamine, N,N'-bis(3,4-dimethylphenyl)biphenyl-4-amine, and dibenzylaniline, 9,9-dimethyl-N,N'-di(p-tolyl)fluorenone-2-amine), aromatic tertiary diamino compounds (for example, N,N'-diphenyl-N,N'-bis(3-methylphenyl)-[1,1-biphenyl]-4,4'-diamine), 1,2,4-triazine derivatives (for example, 3-(4'-dimethylaminophenyl)-5,6-di-(4'-methoxyphenyl)-1,2,4-triazine), hydrazone derivatives (for example, 4-diethylaminobenzaldehyde-1,1-diphenylhydrazone, 4-diphenylaminobenzaldehyde-1,1-diphenylhydrazone, and [p-(diethylamino)phenyl](1-naphthyl)phenylhydrazone), quinazoline derivatives (for example, 2-phenyl-4-styryl-quinazoline), benzofuran derivatives (for example, 6-hydroxy-2,3-di(p-methoxyphenyl)-benzofuran), α-stilbene derivatives (for example, p-(2,2-diphenylvinyl)-N—N'-diphenylaniline), enamine derivatives, carbazole derivatives (for example, N-ethylcarbazole), and poly-N-vinylcarbazole and derivatives thereof; electron transport materials such as quinone compounds (for example, chloranil, bromanil, and anthraquinone), tetracyanoquinodimethane compounds, fluorenone compounds (for example, 2,4,7-trinitrofluorenone, and 2,4,5,7-tetranitro-9-fluorenone), oxadiazole compounds (for example, 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole, xanthone compounds, thiophene compounds, diphenoquinone compounds (for example, 3,3',5,5'-tetra-t-butyl-diphenoquinone); and polymers having a group derived from the above-described compounds in the main chain or a side chain thereof. As the charge transport material, the above-described examples may be used alone or in a combination of two or more kinds.

Binder Resin

Examples of the binder resin include well-known resins such as polycarbonate resins, polyester resins, methacrylic resins, acrylic resins, polyvinylchloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicon resins, silicon-alkyd resins, phenol-formaldehyde resins, styrene-alkyd resins, poly-N-carbazoles, polyvinylbutyrals, polyvinylformals, polysulfones, caseins, gelatins, polyvinyl alcohols, ethylcelluloses, phenol resins, polyamides, carboxymethyl celluoses, vinylidene chloride polymer waxes, and polyurethanes, but are not limited thereto.

As the binder resin, the above-described examples may be used alone or as a mixture of two or more kinds, and polycarbonate resins, polyester resins, methacrylic resins, and acrylic resins are preferably used.

It is preferable that the mixing ratio (in terms of weight ratio) of the binder resin to the charge transport material be from 10:1 to 1:5.

Characteristics of Charge Transport Layer

The thickness of the charge transport layer 32 is preferably from 5 μm to 50 μm and more preferably from 10 μm to 35 μm.

The charge mobility of the charge transport layer 32 is preferably greater than or equal to $1\times10^{-5}$ $cm^2/Vs$ and more preferably greater than or equal to $1.5\times10^{-5}$ $cm^2/Vs$. In this case, the charge mobility is a value obtained at a field intensity of 30 V/μm.

When the charge mobility of the charge transport layer 32 is greater than or equal to $1\times10^{-5}$ $cm^2/Vs$, ghosting is more easily suppressed.

In order to set the charge mobility of the charge transport layer 32 to the above-described range, for example, the kind, the content, and the like of the charge transport material are adjusted.

The charge mobility of the charge transport layer 32 is measured with a Time-of-Flight method.

Formation of Charge Transport Layer

When the charge transport layer 32 is formed, a charge-transport-layer-forming coating solution, in which the above-described components are added to a solvent, is used.

Examples of the solvent used for preparing the charge-transport-layer-forming coating solution, include well-known organic solvents, for example, aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or linear ethers such as tetrahydrofuran and ethyl ether. As the solvent, the above examples may be used alone or as a mixture of two or more kinds.

Examples of a coating method used for providing the charge transport layer 32 include well-known methods such as a blade coating method, a wire-bar coating method, a spray coating method, a dip coating method, a bead coating method, an air knife coating method, and a curtain coating method.

Protective Layer

The protective layer 5 is provided in order to prevent the chemical change of the charge transport layer, when being charged, in the photoreceptor having a laminated structure and to further improve the mechanical strength of the photosensitive layer. As the protective layer, well-known protective layers are used.

Specifically, it is preferable that a layer containing a cross-linking substance (hardened substance) be used as the protective layer 5. Configuration examples of the layer include well-known layer configurations such as a hardened layer having a composition which contains a reactive charge transport material and optionally a hardening resin; and a hardened layer in which the charge transport material is dispersed in a hardening resin. In addition, as the protective layer, a layer in which the charge transport material is dispersed in the binder resin may be used.

The thickness of the protective layer 5 is preferably from 1 m to 20 μm and more preferably from 2 μm to 10 μm.

Examples of a coating method used for providing the protective layer 5 include well-known methods such as a blade coating method, a wire-bar coating method, a spray coating method, a dip coating method, a bead coating method, an air knife coating method, and a curtain coating method.

Examples of a solvent used for coating include well-known organic solvents such as dioxane, tetrahydrofuran, methylene chloride, chloroform, chlorobenzene, and toluene. As the solvent, the above-examples may be used alone or as a mixture of two or more kinds and it is preferable that the solvent having a low solubility of a lower layer be used.

Others

An antioxidant, a light stabilizer, a heat stabilizer, an electron-accepting material, a leveling agent (for example, silicone oil) may be added to the photosensitive layer 3 (for example, the charge transport layer 32) or the protective layer 5 of the photoreceptor according to the exemplary embodiment.

Examples of the antioxidant include hindered phenols, hindered amines, paraphenylenediamines, arylalkanes, hydroquinones, spirochromans, and spiroindanones and derivatives thereof; organic sulfur compounds; and organic phosphorous compounds.

Examples of the light stabilizer include derivatives of benzophenone, benzotriazole, dithiocarbamate, and tetramethylpiperidine.

Examples of the electron-accepting material include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Among these, fluorenones, quinones, and benzene derivatives having an electron-withdrawing substituent such as Cl, ON, or $NO_2$ are particularly preferable.

The photoreceptor according to the exemplary embodiment is preferably applied to an image forming apparatus, such as a laser beam printer, a digital copying machine, a LED printer, or a laser fax machine, which emits infrared light or visible light.

In addition, the photoreceptor according to the exemplary embodiment is used in combination with a normal or reversal developer including a single component or two components.

Image Forming Apparatus

Next, an image forming apparatus according to an exemplary embodiment of the invention will be described.

The image forming apparatus according to the exemplary embodiment of the invention includes the electrophotographic photoreceptor according to the exemplary embodiment; a charging device that charges a surface of the electrophotographic photoreceptor; an electrostatic latent image forming device that forms an electrostatic latent image on a charged surface of the electrophotographic photoreceptor; a developing device that develops the electrostatic latent image, formed on the surface of the electrophotographic photoreceptor, using toner to form a toner image; and a transfer device that transfers the toner image, formed on the surface of the electrophotographic photoreceptor, onto a recording medium.

Figure 7:
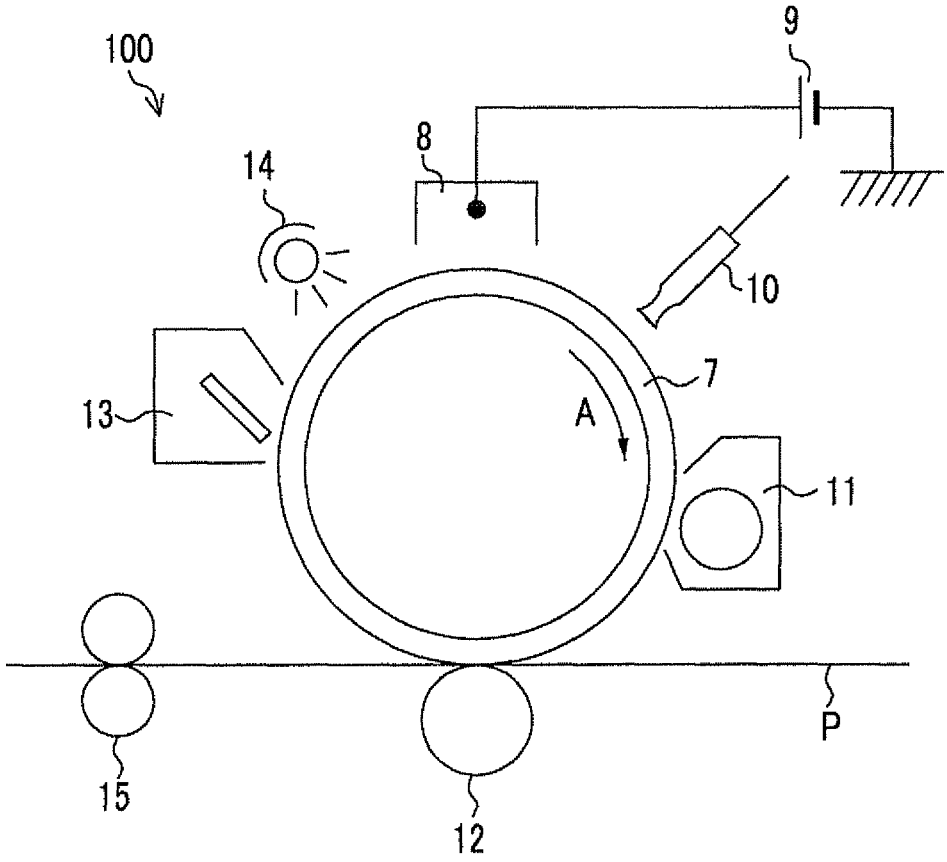
FIG. 7 is a diagram schematically illustrating a configuration of an image forming apparatus according to an exemplary embodiment of the invention.

FIG. 7 is a diagram schematically illustrating a configuration of an image forming apparatus according to an exemplary embodiment of the invention. An image forming apparatus 100 illustrated in FIG. 7 includes a drum-shaped (cylindrical) electrophotographic photoreceptor 7 according to the exemplary embodiment which is rotatably provided. In the vicinity of the electrophotographic photoreceptor 7, a charging device 8, an exposure device 10 (an example of an electrostatic latent image forming device), a developing device 11, a transfer device 12, a cleaning device 13, and an erasing device 14 are provided in this order along a moving direction of the outer circumferential surface of the electrophotographic photoreceptor 7.

From the viewpoint of reduction in cost, a configuration in which the erasing device 14 is not provided may be adopted.

Charging Device

The charging device 8 charges the electrophotographic photoreceptor 7 using corona charging. The charging device 8 is connected to a power supply 9. Examples of the charging device 8 include non-contact roller charging devices; and scorotron charging devices and corotron charging devices using corona discharge.

In addition, other examples thereof include known charging devices such as contact charging devices using a charging roller, a charging brush, a charging film, a charging rubber blade, a charging tube, and the like which are conductive.

Figure 8:
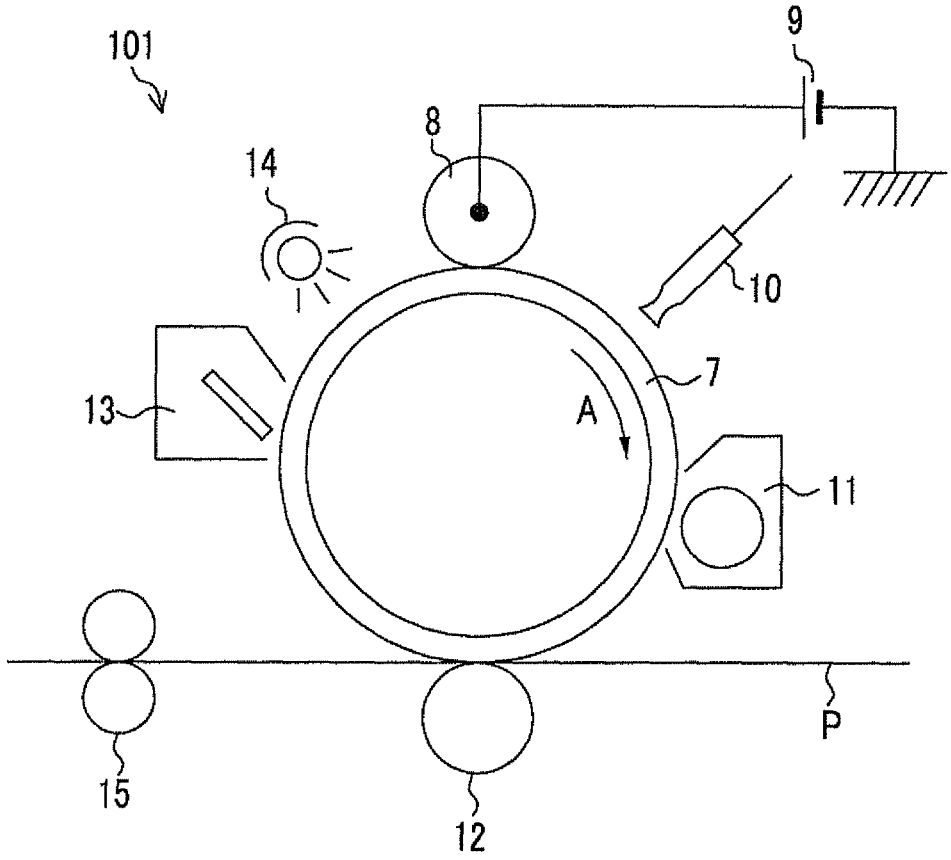
FIG. 8 is a diagram schematically illustrating a configuration of an image forming apparatus according to another exemplary embodiment of the invention.

FIG. 8 is a diagram schematically illustrating an example of a contact charging type image forming apparatus using the electrophotographic photoreceptor according to the exemplary embodiment.

The above-described contact charging member is provided so as to be in contact with a surface of the photoreceptor, and applies voltage directly to the photoreceptor to charge the surface of the photoreceptor to a predetermined potential. Examples of the contact charging member include members in which metal oxide particles of carbon black, copper iodide, silver iodide, zinc sulfide, silicon carbide, metal oxide, or the like are dispersed in a metal such as aluminum, iron, or copper, a conductive polymer material such as polyacetylene, polypyrrole, or polythiophene, or an elastomer material such as polyurethane rubber, silicone rubber, epichlorohydrin rubber, ethylenepropylene rubber, acrylic rubber, fluororubber, styrene-butadiene rubber, or butadiene rubber.

Examples of the metal oxide used for the contact charging member include ZnO, $SnO_2$, $TiO_2$, $In_2O_3$, and $MoO_3$; and complex oxides thereof. In addition, conductivity may be imparted thereto by adding perchlorate to an elastomer material.

Furthermore, a coating layer may be provided on the surface. Examples of a material of forming the coating layer include N-alkoxymethyl nylon, cellulosic resins, vinylpyridine resins, phenol resins, polyurethanes, polyvinylbutyral, and melamine. As the material of forming the coating layer, the above examples may be used alone or in combination.

In addition, emulsion resin materials such as acrylic resin emulsion, polyester resin emulsion, and polyurethane, in particular, an emulsion resin synthesized by polymerization of soap-free emulsion may also be used. In order to adjust resistivity, conductive particles may be further dispersed in the resin or an antioxidant may be added thereto. In addition, the emulsion resin may include a leveling agent or a surfactant.

Examples of a shape of the contact charging member include a roller shape, a blade shape, a belt shape, and a brush shape. The resistance value of the contact charging member is preferably from $10^2$ Ωcm to $10^{12}$ Ωcm and more preferably from $10^3$ Ωcm to $10^8$ Ωcm. In addition, voltage may be applied to the contact charging member in the form of DC or DC+AC.

Exposure Device

The exposure device 10 forms an electrostatic latent image on the electrophotographic photoreceptor 7 by exposing the charged electrophotographic photoreceptor 7 to light. Examples of the exposure device 10 include optical devices in which the surface of the electrophotographic photoreceptor 7 is imagewise exposed to light such as semiconductor laser light, LED light, and liquid crystal shutter light. It is preferable that the wavelength of a light source fall within the spectral sensitivity range of the electrophotographic photoreceptor 7. It is preferable that the wavelength of a semiconductor laser light be in the near-infrared range having an oscillation wavelength of about 780 nm. However, the wavelength is not limited thereto. Laser light having an oscillation wavelength of about 600 nm or laser light having an oscillation wavelength of 400 nm to 450 nm as blue laser light may be used. In addition, in order to form a color image, as the exposure device 10, for example, a surface-emitting laser light source emitting multiple beams is also effective.

Developing Device

The developing device 11 forms a toner image by developing the electrostatic latent image using a developer. It is preferable that the developer include toner particles with a volume average particle diameter of 3 μm to 9 μm which is obtained by polymerization. The developing device 11 has a configuration in which a developing roller is disposed opposite the electrophotographic photoreceptor 7 in a developing region of a container containing a two-component developer which includes toner and a carrier.

Transfer Device

The transfer device 12 transfers the toner image, which is developed on the electrophotographic photoreceptor 7, onto a transfer medium. Examples of the transfer device 12 include contact transfer charging devices using a belt, a roller, a film, a rubber blade, and the like; and well-known transfer charging devices such as scorotron transfer charger or corotron transfer charger using corona discharge.

Cleaning Device

The cleaning device 13 removes toner remaining on the electrophotographic photoreceptor 7 after transfer. It is preferable that the cleaning device 13 include a blade member which is in contact with the electrophotographic photoreceptor 7 at a linear pressure of from 10 g/cm to 150 g/cm. The cleaning device 13 includes, for example, a case, a cleaning blade, and a cleaning brush which is disposed downstream of the cleaning blade in a rotating direction of the electrophotographic photoreceptor 7. In addition, for example, a solid lubricant is disposed in contact with the cleaning brush.

Erasing Device

The erasing device 14 erases a potential remaining on the surface of the electrophotographic photoreceptor by irradiating the surface of the electrophotographic photoreceptor 7 with erasing light after the toner image is transferred. For example, the erasing device 14 removes the difference between potentials of an exposed portion and an unexposed portion which is generated on the surface of the electrophotographic photoreceptor 7 by the exposure device 10, by irradiating the entire area of the electrophotographic photoreceptor 7 with erasing light in an axial direction and a width direction. A configuration in which the erasing device 14 is not provided may be adopted.

Fixing Device

The image forming apparatus 100 includes a fixing device 15 which fixes the toner image on a transfer medium after the transfer process. The fixing device is not particularly limited and examples thereof include well-known fixing devices such as a heat roller fixing device and an oven fixing device.

Next, the operations of the image forming apparatus 100 according to the exemplary embodiment will be described. First, the electrophotographic photoreceptor 7 is charged to a negative potential by the charging device 8 while rotating along a direction indicated by arrow A. The surface of the electrophotographic photoreceptor 7, which is charged to a negative potential by the charging device 8, is exposed to light by the exposure device 10 and an electrostatic latent image is formed thereon.

When a portion of the electrophotographic photoreceptor 7, where the electrostatic latent image is formed, approaches the developing device 11, toner is attached onto the electrostatic latent image by the developing device 11 and thus a toner image is formed.

When the electrophotographic photoreceptor 7 where the toner image is formed further rotates in the direction indicated by arrow A, the toner image is transferred onto a recording paper P by the transfer device 12. As a result, the toner image is formed on the recording paper P.

The toner image, which is formed on the recording paper P, is fixed on the recording paper P by the fixing device 15.

Process Cartridge

The image forming apparatus according to the exemplary embodiment may include a process cartridge which includes the electrophotographic photoreceptor 7 according to the exemplary embodiment and is detachable from the image forming apparatus.

The process cartridge according to the exemplary embodiment is not limited as long as it includes the electrophotographic photoreceptor 7 according to the exemplary embodiment. For example, in addition to the electrophotographic photoreceptor 7, the process cartridge may further include at least one component selected from the charging device 8, the exposure device 10, the developing device 11, the transfer device 12, the cleaning device 13, and the erasing device 14:

In addition, the image forming apparatus according to the exemplary embodiment is not limited to the above-described configurations and well-known configurations may be adopted. For example, an intermediate transfer type image forming apparatus, in which the toner image, which is formed on the electrophotographic photoreceptor 7, is transferred onto an intermediate transfer medium and then transferred onto the recording paper P, may be adopted; or a tandem-type image forming apparatus may be adopted.

EXAMPLES

Hereinafter, the exemplary embodiments will be described in detail with reference to Examples and Comparative Examples, but the exemplary embodiments are not limited to Examples below. In the following description, "part" represents "part by weight" unless specified otherwise.

Example 1

As a photoreceptor substrate, a diameter 30 mmϕ cut aluminum pipe is prepared.

Next, 100 parts of zinc oxide (average particle size: 70 nm, manufactured by TAYCA CORPORATION, specific surface area: 15 $m^2/g$) and 500 parts of toluene are stirred and mixed and 0.75 part of silane coupling agent (KBM 603, manufactured by Shin-Etsu Chemical Co., Ltd.) is added thereto, followed by stirring for 2 hours. Then, toluene is removed by distillation under reduced pressure, followed by baking at 120° C. for 3 hours. As a result, a zinc oxide pigment with surfaces treated with the silane coupling agent is obtained.

Next, 60 parts of the surface-treated zinc oxide pigment, 0.6 part of alizarin, 13.5 parts of curing agent (blocked isocyanate, SUMIDUR 3175, manufactured by Sumitomo Bayer Urethane Co., Ltd.), and 15 parts of butyral resin (S-LEC BM-1, manufactured by SEKISUI CHEMICAL CO., LTD.) are dissolved in 85 parts of methyl ethyl ketone to obtain a solution. 38 parts of the solution and 25 parts of methyl ethyl ketone are mixed and dispersed for 2 hours with a sand mill using diameter 1 mmϕ glass beads. As a result, a dispersion is obtained.

0.005 part of dioctyl tin dilaurate as a catalyst and 4.0 parts of silicone resin particles (TOSPEARL 145, manufactured by GE Toshiba Silicones Co., Ltd.) are added to the obtained dispersion. As a result, an undercoat-layer-forming coating solution is obtained.

The undercoat-layer-forming coating solution is dip-coated on the photosensitive substrate (cut aluminum pipe), followed by drying and curing at 180° C. for 24 minutes. As a result, an undercoat layer with a thickness of 32 μm is obtained. The hardness of the obtained undercoat layer is 0.80.

Next, 15 parts of hydroxygallium phthalocyanine having diffraction peaks at Bragg angles)(2θ±0.2°) of at least 7.3°, 16.0°, 24.9°, and 28.0° in an X-ray diffraction spectrum using CuKα, as the charge generation material; 10 parts of vinyl chloride-vinyl acetate copolymer resin (VMCH, manufactured by Dow Chemical Company) as the binder resin, and 200 parts of n-butyl acetate are mixed to obtain a mixture. The mixture is dispersed for 4 hours with a sand mill using diameter 1 mmϕ glass beads.

175 parts of n-butyl acetate and 180 parts of methyl isobutyl ketone are added to the obtained dispersion, followed by stirring. As a result, a charge-generation-layer-forming coating solution is obtained.

This charge-generation-layer-forming coating solution is dip-coated on the undercoat layer, followed by drying at room temperature. As a result, a charge generation layer with a thickness of 0.2 μm is formed.

Next, 1.8 parts of polytetrafluoroethylene particles (average particle size: 0.2 μm) is added to a solution obtained by dissolving 0.06 part of fluorine graft polymer GF 400 (manufactured by TOAGOSEI CO., LTD.) in 4.3 parts of toluene, followed by stirring and mixing for 48 hours while maintaining the liquid temperature at 20° C. As a result, a polytetrafluoroethylene particle suspension (A solution) is obtained.

Next, 4 parts of tris[4-(4,4-diphenyl-1,3-butadienyl)phenyl]amine, which is a compound having a structure represented by Structural Formula 1, as the charge transport material; 6 parts of polycarbonate copolymer having repeating units represented by Structural Formulae 2 and 3 as the binder resin; and 0.1 part of 2,6-di-t-butyl-4-methylphenol as the antioxidant are mixed. The mixture is mixed with and dissolved in 24 parts of tetrahydrofuran and 11 parts of toluene. As a result, B solution is obtained.

The A solution is added to the B solution, followed by stirring and mixing. The resultant is dispersed 6 times under an increased pressure of 500 kgf/cm2 using a high-pressure homogenizer (manufactured by Yoshida Kikai Co., Ltd.) to which a pass-through chamber having fine flow paths is mounted, thereby obtaining a solution. 5 ppm of silicone oil (trade name: KP 340, manufactured by Shin-Etsu Chemical Co., Ltd.) is added to the obtained solution, followed by sufficient stirring. As a result, a charge-transport-layer-forming coating solution is obtained.

This charge-transport-layer-forming coating solution is coated on the charge generation layer, followed by drying at 143° C. for 24 minutes. As a result, a charge transport layer with a thickness of 24 μm is formed.

Structural Formula 1

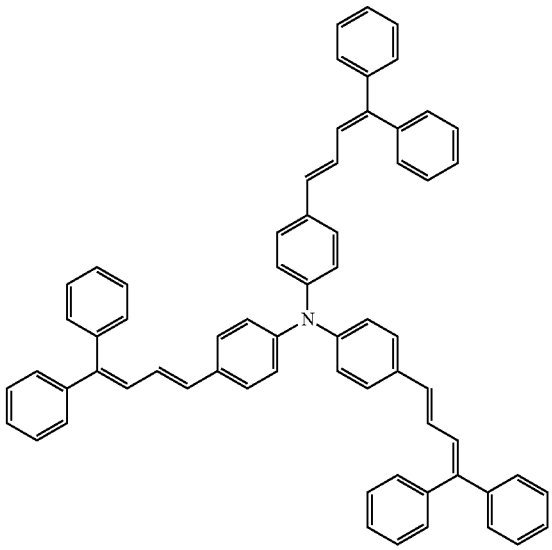

Structural Formula 2

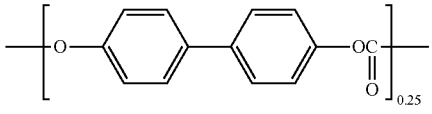

Structural Formula 3

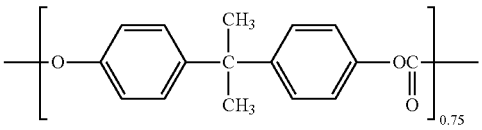

Through the above-described processes, a target photoreceptor 1 is prepared.

Example 2

A target photoreceptor 2 is obtained in the same preparation method as that of Example 1, except that, when an undercoat layer is formed, the amount of alizarin mixed in is changed to 0.3 part.

Example 3

A target photoreceptor 3 is obtained in the same preparation method as that of Example 1, except that, when an undercoat layer is formed, the amount of alizarin mixed in is changed to 0.3 part and the amount of silane coupling agent (KBM 603, manufactured by Shin-Etsu Chemical Co., Ltd.) added is changed to 0.5 part.

Example 4

A target photoreceptor 4 is obtained in the same preparation method as that of Example 1, except that, when an undercoat layer is formed, the amount of silane coupling agent (KBM 603, manufactured by Shin-Etsu Chemical Co., Ltd.) added is changed to 0.5 part.

Example 5

A target photoreceptor 5 is obtained in the same preparation method as that of Example 1, except that, when an undercoat layer is formed, the amount of alizarin mixed in is changed to 0.3 part and the amount of silane coupling agent (KBM 603, manufactured by Shin-Etsu Chemical Co., Ltd.) added is changed to 1.0 part.

Example 6

A target photoreceptor 6 is obtained in the same preparation method as that of Example 1, except that, when an undercoat layer is formed, the amount of silane coupling agent (KBM 603, manufactured by Shin-Etsu Chemical Co., Ltd.) added is changed to 1.0 part.

Example 7

A target photoreceptor 7 is obtained in the same preparation method as that of Example 1, except that, when an undercoat layer is formed, the amount of alizarin mixed in is changed to 0.9 part.

Example 8

A target photoreceptor 8 is obtained in the same preparation method as that of Example 1, except that, when an undercoat layer is formed, the following Compound A is used instead of alizarin.

Compound A

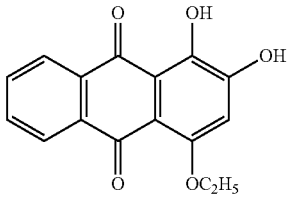

Example 9

A target photoreceptor 9 is obtained in the same preparation method as that of Example 1, except that, when an undercoat layer is formed, the thickness of the undercoat layer is changed to 24 μm.

Comparative Example 1

A target photoreceptor 10 is obtained in the same preparation method as that of Example 1, except that, when an undercoat layer is formed, the amount of alizarin mixed in is changed to 0.3 part and the amount of silane coupling agent (KBM 603, manufactured by Shin-Etsu Chemical Co., Ltd.) added is changed to 1.25 parts.

Comparative Example 2

A target photoreceptor 11 is obtained in the same preparation method as that of Example 1, except that, when an undercoat layer is formed, the amount of alizarin mixed in is changed to 0.3 part and the silane coupling agent (KBM 603, manufactured by Shin-Etsu Chemical Co., Ltd.) is not added.

Comparative Example 3

A target photoreceptor 12 is obtained in the same preparation method as that of Example 1, except that, when an undercoat layer is formed, alizarin is not mixed in.

Comparative Example 4

A target photoreceptor 13 is obtained in the same preparation method as that of Example 1, except that, when an undercoat layer is formed, the amount of alizarin mixed in is changed to 1.2 parts.

Example 10

A target photoreceptor 14 is obtained in the same preparation method as that of Example 1, except that, when an undercoat layer is formed, the thickness of the undercoat layer is changed to 15 μm.

Example 11

A target photoreceptor 15 is obtained in the same preparation method as that of Example 1, except that, when an undercoat layer is formed, the thickness of the undercoat layer is changed to 50 μm.

Example 12

A target photoreceptor 16 is obtained in the same preparation method as that of Example 1, except that, when a charge transport layer is formed, the thickness of the charge transport layer is changed to 50 μm.

Example 13

A target photoreceptor 17 is obtained in the same preparation method as that of Example 1, except that, when a charge transport layer is formed, C solution is used instead of the B solution, the C solution being obtained by mixing 9.8 parts of N,N'-bis(3-methylphenyl)-N,N'-diphenylbenzidine, 13.0 parts of bisphenol Z type polycarbonate resin (viscosity average molecular weight: 40,000), and 0.2 part of 2,6-di-t-butyl-4-methylphenol as the antioxidant; and mixing and dissolving the mixture in 48.3 parts of tetrahydrofuran and 18.2 parts of toluene.

EVALUATION

Evaluation for Characteristics

The contact angle with respect to water of the metal oxide particles of the undercoat layer constituting each photoreceptor of the respective examples (in Table, shown as "Water Contact Angle"); and the charge mobility (at a field intensity of 30 V/μm) of the charge transport layer are examined according to existing methods. The results thereof are shown in Table 1.

Performance Evaluation ghosting and changes in cycle characteristics are evaluated using a modified machine of DocuPrint 505 (manufactured by Fuji Xerox) in which each photoreceptor of the respective examples is mounted to a drum cartridge. The results thereof are shown in Table 1.

Evaluation for Ghosting

The evaluation for ghosting is performed with a method in which, in an environment of 28° C. and 85 RH %, a chart with an image density of 100%, which has a width of 2 mm in an axial direction of the photoreceptor and continues in a circumferential direction, is continuously printed on 200 sheets of paper, and then a halftone image having an image density of 30% on the entire surface is printed. The evaluation is performed by visually inspecting changes in density of the halftone image.

Evaluation Criteria

A: Change in density does not occur

B: A very small amount of change in density occurs

C: Change in density occurs to a degree where there are no problems in practice

D: A significant amount of change in density occurs

Cycle Characteristics

The cycle characteristics are evaluated with a method in which, in an environment of 28° C. and 85 RH %, a random chart having an image density of 5% is continuously printed on 10,000 sheets of paper; immediately after, a surface potential probe is installed at an intermediate position between the charging device and the exposure device; and the difference (increased amount of residual potential) between residual potentials (V), measured using a surface potential meter Trek 334 (manufactured by TREK JAPAN Co., Ltd.) before and immediately after printing 10,000 sheets of paper, is calculated. The evaluation is performed based on the following evaluation criteria.

Evaluation Criteria

A: less than or equal to 10 V

B: greater than 10 V and less than or equal to 15 V

C: greater than 15 V and less than or equal to 20 V

D: greater than 20 V

TABLE 1

| | Undercoat Layer | | | Charge Transport Layer | Evaluation | |
|---|---|---|---|---|---|---|
| | Electron-Accepting Compound Kind/Amount Mixed In | Metal Oxide Particles Kind/Water Contact Angle | Thickness (μm) | Charge Mobility ($cm^2/Vs$) | Ghost | Cycle Characteristics |
| Example 1 | Alizarin/1.0% by weight | Zinc Oxide/10° | 32 | $1.5 \times 10^{-5}$ | A | A |
| Example 2 | Alizarin/0.5% by weight | Zinc Oxide/10° | 32 | $1.5 \times 10^{-5}$ | B | B |
| Example 3 | Alizarin/0.5% by weight | Zinc Oxide/12° | 32 | $1.5 \times 10^{-5}$ | B | B |
| Example 4 | Alizarin/1.0% by weight | Zinc Oxide/12° | 32 | $1.5 \times 10^{-5}$ | B | B |
| Example 5 | Alizarin/0.5% by weight | Zinc Oxide/7° | 32 | $1.5 \times 10^{-5}$ | B | B |
| Example 6 | Alizarin/1.0% by weight | Zinc Oxide/7° | 32 | $1.5 \times 10^{-5}$ | B | B |
| Example 7 | Alizarin/1.5% by weight | Zinc Oxide/10° | 32 | $1.5 \times 10^{-5}$ | B | A |
| Example 8 | Compound A/1.0% by weight | Zinc Oxide/10° | 32 | $1.5 \times 10^{-5}$ | A | A |
| Example 9 | Alizarin/1.0% by weight | Zinc Oxide/10° | 24 | $1.5 \times 10^{-5}$ | B | A |
| Comparative Example 1 | Alizarin/0.5% by weight | Zinc Oxide/5° | 32 | $1.5 \times 10^{-5}$ | B | C |
| Comparative Example 2 | Alizarin/0.5% by weight | Zinc Oxide/13° | 32 | $1.5 \times 10^{-5}$ | D | C |
| Comparative Example 3 | — | Zinc Oxide/10° | 32 | $1.5 \times 10^{-5}$ | C | D |
| Comparative Example 4 | Alizarin/2.0% by weight | Zinc Oxide/10° | 32 | $1.5 \times 10^{-5}$ | D | A |
| Example 10 | Alizarin/1.0% by weight | Zinc Oxide/10° | 15 | $1.5 \times 10^{-5}$ | B | A |
| Example 11 | Alizarin/1.0% by weight | Zinc Oxide/10° | 50 | $1.5 \times 10^{-5}$ | B | B |
| Example 12 | Alizarin/1.0% by weight | Zinc Oxide/10° | 32 | $1.5 \times 10^{-6}$ | B | B |
| Example 13 | Alizarin/1.0% by weight | Zinc Oxide/10° | 32 | $7.0 \times 10^{-6}$ | B | B |

It can be seen from the above results that, when the Examples are compared to the Comparative Examples, superior results are obtained in Examples in the evaluations for ghosting and cycle characteristics.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a support;

an undercoat layer which is provided on the support and contains at least a binder resin, metal oxide particles, and an electron-accepting compound having an anthraquinone structure, in which a content of the electron-accepting compound is from 0.5% by weight to 1.5% by weight with respect to the metal oxide particles and a contact angle of the metal oxide particles with respect to water is from 7° to 12°; and a photosensitive layer which is provided on the undercoat layer, wherein surfaces of the metal oxide particles are treated with a surface treating agent, and an amount of the surface treating agent is from 0.5% by weight to 1.0% by weight with respect to the metal oxide particles.

2. The electrophotographic photoreceptor according to claim 1, wherein the contact angle of the metal oxide particles with respect to water is from 9° to 11°.

3. The electrophotographic photoreceptor according to claim 1, wherein the content of the electron-accepting compound is from 0.75% by weight to 1.25% by weight with respect to the metal oxide particles.

4. The electrophotographic photoreceptor according to claim 1, wherein the content of the electron-accepting compound is from 0.75% by weight to 1.0% by weight with respect to the metal oxide particles.

5. The electrophotographic photoreceptor according to claim 1, wherein the electron-accepting compound includes a hydroxyl group.

6. The electrophotographic photoreceptor according to claim 1, wherein the surface treating agent is a silane coupling agent.

7. The electrophotographic photoreceptor according to claim 1, wherein the surface treating agent is a silane coupling agent having an amino group.

8. The electrophotographic photoreceptor according to claim 1, wherein a thickness of the undercoat layer is from 20 μm to 50 μm.

9. The electrophotographic photoreceptor according to claim 1, wherein a thickness of the undercoat layer is from 20 μm to 40 μm.

10. The electrophotographic photoreceptor according to claim 1, wherein a thickness of the undercoat layer is from 23 μm to 33 μm.

11. The electrophotographic photoreceptor according to claim 1, wherein the undercoat layer has a resistance value of from $1\times10^{8}\Omega$ to $1\times10^{10}\Omega$ in AC impedance measurement.

12. The electrophotographic photoreceptor according to claim 1, wherein the photosensitive layer includes a charge generation layer and a charge transport layer, and a charge mobility of the charge transport layer at a field intensity of 30 V/μm is greater than or equal to $1\times10^{-5}$ $cm^2/Vs$.

13. The electrophotographic photoreceptor according to claim 1, wherein the photosensitive layer includes a charge generation layer and a charge transport layer, and a charge mobility of the charge transport layer at a field intensity of 30 V/μm is greater than or equal to $1.5\times10^{-5}$ $cm^2/Vs$.

14. An image forming apparatus comprising:

the electrophotographic photoreceptor according to claim 1;

a charging device that charges a surface of the electrophotographic photoreceptor;

an electrostatic latent image forming device that forms an electrostatic latent image on a charged surface of the electrophotographic photoreceptor;

a developing device that develops the electrostatic latent image, formed on the surface of the electrophotographic photoreceptor, using toner to form a toner image; and a transfer device that transfers the toner image, formed on the surface of the electrophotographic photoreceptor, onto a recording medium.

15. A process cartridge, which is detachable from an image forming apparatus, comprising:

the electrophotographic photoreceptor according to claim 1.

* * * * *